US009605519B2

(12) United States Patent
Richard et al.

(10) Patent No.: US 9,605,519 B2
(45) Date of Patent: Mar. 28, 2017

(54) NON-BALLISTIC TUBULAR PERFORATING SYSTEM AND METHOD

(71) Applicants: Bennett M. Richard, Kingwood, TX (US); Edward J. O'Malley, Houston, TX (US)

(72) Inventors: Bennett M. Richard, Kingwood, TX (US); Edward J. O'Malley, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 786 days.

(21) Appl. No.: 13/949,961

(22) Filed: Jul. 24, 2013

(65) Prior Publication Data

US 2015/0027709 A1 Jan. 29, 2015

(51) Int. Cl.
*E21B 43/114* (2006.01)
*E21B 43/112* (2006.01)

(52) U.S. Cl.
CPC ..... *E21B 43/114* (2013.01); *E21B 43/112* (2013.01)

(58) Field of Classification Search
CPC ..... E21B 43/112; E21B 43/114
See application file for complete search history.

(56) References Cited

U.S. PATENT DOCUMENTS 3,273,641 A 9/1966 Bourne
5,094,103 A 3/1992 Wicks, III
5,515,915 A 5/1996 Jones et al.
6,619,398 B2 9/2003 MacKenzie et al.
6,662,873 B1 12/2003 Nguyen et al.
6,755,249 B2 6/2004 Robison et al.
6,834,725 B2 12/2004 Whanger et al.
7,243,732 B2 7/2007 Richard
7,318,481 B2 1/2008 Richard
7,392,852 B2 7/2008 Richard
7,578,347 B2 8/2009 Bosma
7,690,437 B2 4/2010 Guillot et al.
7,784,532 B2 8/2010 Sevre et al.
7,866,393 B2 1/2011 Badalamenti et al.
8,104,538 B2 1/2012 Richard et al.
8,967,276 B2 3/2015 Mazyar et al.
(Continued)

FOREIGN PATENT DOCUMENTS

AU 2011218707 A1 9/2011
WO 2011131306 A1 10/2011
(Continued)

OTHER PUBLICATIONS

Notification of Transmittal of the International Search Report and the Written Opinion of the International Searching Authority; PCT/US2014/044505; Korean Intellectual Property Office; Mailed Oct. 27, 2014, 15 pages.
(Continued)

*Primary Examiner* — David Bagnell
*Assistant Examiner* — Kristyn Hall
(74) *Attorney, Agent, or Firm* — Cantor Colburn LLP

(57) ABSTRACT

A non-ballistic tubular perforating system includes a tubular having a wall with perforations therethrough and at least one radially extendable member positioned radially of the perforations configured to displace cement radially of the tubular and configured to radially extend prior to pumping of the cement.

24 Claims, 2 Drawing Sheets

(56) References Cited

U.S. PATENT DOCUMENTS

| | | | | |
|---|---|---|---|---|
| 2003/0070811 | A1 | 4/2003 | Robison et al. | |
| 2004/0168804 | A1 | 9/2004 | Reddy | |
| 2005/0205263 | A1 | 9/2005 | Richard | |
| 2006/0048939 | A1* | 3/2006 | Johnson | B09B 1/008 166/285 |
| 2006/0124310 | A1 | 6/2006 | Cardenas et al. | |
| 2006/0207765 | A1 | 9/2006 | Hofman et al. | |
| 2008/0210423 | A1 | 9/2008 | Boney | |
| 2008/0289823 | A1 | 11/2008 | Willberg et al. | |
| 2009/0188569 | A1 | 7/2009 | Saltel | |
| 2010/0096119 | A1 | 4/2010 | Sevre et al. | |
| 2010/0230103 | A1 | 9/2010 | Parker | |
| 2010/0300689 | A1 | 12/2010 | McRobb et al. | |
| 2010/0314111 | A1 | 12/2010 | Karcher | |
| 2011/0077324 | A1 | 3/2011 | Ravi | |
| 2011/0135953 | A1 | 6/2011 | Xu | |
| 2011/0220359 | A1 | 9/2011 | Soliman et al. | |
| 2011/0220362 | A1 | 9/2011 | Huang | |
| 2011/0226479 | A1 | 9/2011 | Tippel et al. | |
| 2011/0284229 | A1 | 11/2011 | Radmanovich et al. | |
| 2012/0073819 | A1* | 3/2012 | Richard | E21B 33/10 166/308.1 |
| 2012/0175134 | A1 | 7/2012 | Robisson et al. | |
| 2012/0261127 | A1 | 10/2012 | Zhou | |
| 2013/0140043 | A1 | 6/2013 | Swanson et al. | |
| 2013/0180725 | A1 | 7/2013 | Richard et al. | |
| 2013/0199843 | A1 | 8/2013 | Ross | |
| 2014/0110119 | A1 | 4/2014 | Luyster et al. | |
| 2015/0090448 | A1 | 4/2015 | O'Malley et al. | |
| 2015/0090449 | A1 | 4/2015 | O'Malley et al. | |

FOREIGN PATENT DOCUMENTS

| | | | |
|---|---|---|---|
| WO | 2011131307 | A1 | 10/2011 |
| WO | WO2013109408 | A1 | 7/2013 |

OTHER PUBLICATIONS

International Search Report and the Written Opinion of the International Searching Authority; PCT/US2014/050635; Mailed Nov. 28, 2014; 13 pages.

PCT International Search Report and the Written Opinion of the International Searching Authority; PCT/US2014/050638; Nov. 21, 2014, 15 pages.

Bob Brooks, Tim Davis, Frank Delucia, TAM International, "Use of Swellable Elastomers to Enhance Cementation in Deep Water Applications," Paper Presentaton for Deep Offshore Technology Conference-International, Feb. 12-14, 2008, pp. 1-13, Houston.

Brent Miller and John Paneitz, Whiting Petroleum Corporation, and Sean Yakely and Kent Evans, Baker Hughes, "Unlocking Tight Oil: Selective Multi-Stage Fracturing in the Bakken Shale," SPE Annual Technical Conference and Exhibition, Sep. 21-24, 2008.

Notification of Transmittal of the International Preliminary Report on Patentability and Written Opinion of the International Searching Authority, or the Declaration; PCT/US2013/020049; Jul. 22, 2014 , 7 pages.

Notification of Transmittal of the International Search Report and Written Opinion of the International Searching Authority, or the Declaration; PCT/US2013/020049; Apr. 10, 2013, 9 pages.

"FracPoint MP Sleeve with DirectConnect Ports"; Baker Hughes Incorporated; Trade Show Material, 2012; 4 pages.

"FracPoint MP Sleeve with DirectConnect Ports"; Baker Hughes Incorporated; Trade Show Material, 2011; 2 pages.

A.S. Metcalf et al., "Case Histories of Successful Acid Stimulation of Carbonate Completed With Horizontal Open Hole Wellbores"; Journal of Canadian Petroleum Technology, vol. 48, No. 6; Jun. 2006, 5 pages.

* cited by examiner

NON-BALLISTIC TUBULAR PERFORATING SYSTEM AND METHOD

BACKGROUND

Opening perforations through walls of a tubular to allow fluid flow therethrough after deployment of the tubular within a structure is not uncommon One method of opening such perforations is through ignition of ballistic devices, referred to as guns. Due to the explosive nature of the guns shipment of them through some jurisdictions is not permitted. The art is, therefore, always receptive to alternate methods of opening perforations in tubulars that do not require guns.

BRIEF DESCRIPTION

Disclosed herein is a non-ballistic tubular perforating system. The system includes a tubular having a wall with perforations therethrough and at least one radially extendable member positioned radially of the perforations configured to displace cement radially of the tubular and configured to radially extend prior to pumping of the cement.

Further disclosed herein is a method of opening perforations in a tubular system. The method includes radially increasing a radially increasable member positioned radially outwardly of perforations in a tubular positioned within a borehole in an earth formation, cementing an annular space between the tubular and the borehole, displacing cement with the radial increasing of the radially increasable member, pumping fluid through the tubular and breaching the radially increasable member and establishing fluidic communication between an inside of the tubular and the earth formation.

Further disclosed herein is a non-ballistic tubular perforating system. The system includes a tubular having a wall with perforations therethrough, at least one radially extendable member oriented radially of the tubular proximate the perforations configured to prevent cement from being positioned radially of the perforations when in a radially extended condition and at least one occluding member configured to initially prevent fluid inside the tubular from reaching the radially extendable member.

Further disclosed herein is a non-ballistic tubular perforating system. The system includes a tubular having a wall with perforations therethrough and at least one radially extendable member positioned radially of the perforations configured to displace cement radially of the tubular.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
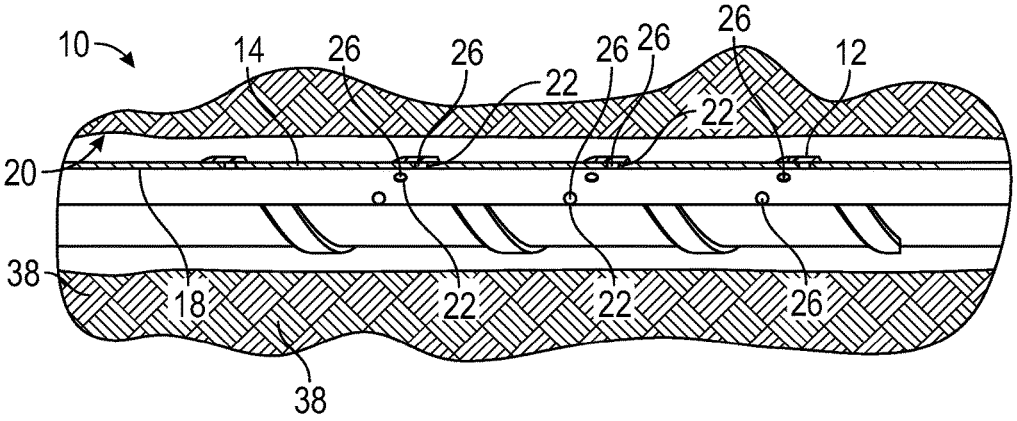
FIG. 1 depicts a partial quarter cross sectional view of an alternate embodiment of a non-ballistic tubular perforating system disclosed herein with a radially extendable member in an non-extended condition.
Figure 2:
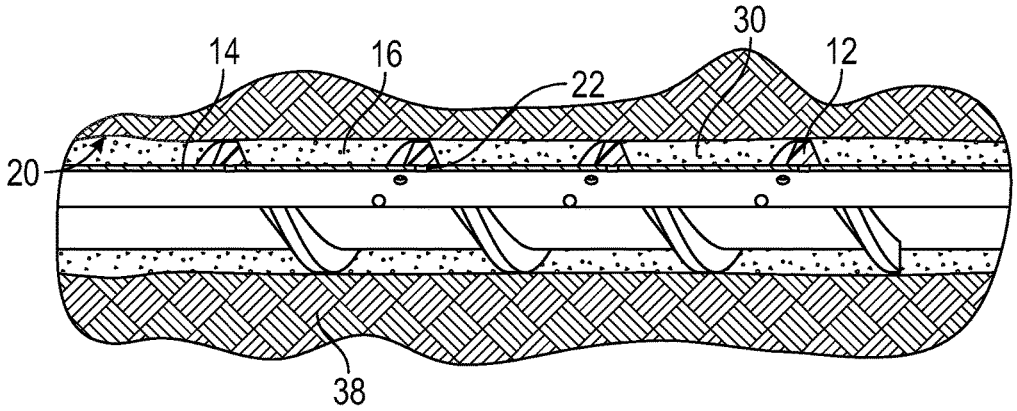
FIG. 2 depicts a partial quarter cross sectional view of the non-ballistic tubular perforating system of FIG. 1 with the radially extendable member swollen and cement pumped therearound.

A detailed description of one or more embodiments of the disclosed apparatus and method are presented herein by way of exemplification and not limitation with reference to the Figures.

Referring to FIGS. 1 through 4, an embodiment of a non-ballistic tubular perforating system disclosed herein is illustrated at 10. The system 10 includes, a tubular 14 having a wall 18 with perforations 22 therethrough. Optional plugs 26 are positioned within the perforations 22 thereby preventing fluid from flowing therethrough. The plugs 26 are made of a material that is dissolvable in a selected environment as will be elaborated on below. Cement 30 (shown in FIGS. 2-4 only) is positionable radially of the tubular 14 in an annular space 16 defined between embodiment, in an earth formation 38. At least one radially extendable member 12 is positioned radially outwardly of the tubular 14 in locations covering the perforations 22 with a single continuous one of the radially extendable member 12 being illustrate in this embodiment that is wrapped helically around the tubular 14.

The radially extendable member 12 can be a swellable material, an inflatable member, a shape memory material or other device that can increase radially while surrounding the tubular 14. In embodiments wherein the radially extendable member 12 is swellable, an additional volume of the cement 30 displaced is substantially equal to the change in volume of the swellable material 12. In an embodiment wherein the radially extendable member 12 is a shape memory material such as a shape memory polymer, for example, the volume of the cement 30 displaced needs not change as the shape memory material 12 changes shape since the radial increase of the shape memory material 12 can be offset by a reduction in the longitudinal dimension of the shape memory material 12 thereby leaving the volume of the shape memory material 12 substantially constant.

Since, in some embodiments, the radially extendable member 12 can increase dimensionally in both radial and longitudinal directions simultaneously, its volume can change. The radially extendable member 12 can be configured to swell at selected rates and in response to exposure to selected environments including fluids and temperatures that are anticipated to be present in the downhole environment, or fluids that can be pumped into contact with the radially extendable members 12. For example, in one embodiment the radially extendable member 12 can be configured to swell after the cement 30 has been pumped into the annular space 16 but before the cement 30 has hardened or cured. Such a configuration allows the cement 30 to flow through the annular space 16 and between the walls 20 and the radially extendable member 12 prior to it swelling. The swelling of the swellable material 12 can then displace more of the uncured cement 30 and create contact with the walls 20 directly. This configuration allows fluid under pressure within the tubular 14 to flow through the perforations 22 (after dissolution of the plugs 26, if so equipped) to the radially extendable member 12. The radially extendable member 12 can be selected to be more easily breached by pressurized fluid acting thereagainst than is the cement 30. Consequently, pressuring up within the tubular 14 can cause fluid to flow through the perforations 22 and breach (or rupture) the radially extendable member 12 thereby establishing fluidic communication between an inside of the tubular 14 and the earth formation 38. This fluid communication allows treating of the formation 38. Such treatments include fracturing, pumping proppant and acid treating, for example. Additionally, the system 10 would allow for production of fluids, such as hydrocarbons, for example, from the formation 38.

The plugs 26 can prevent fluid inside the tubular 14 from reaching the radially extendable member 12 until the plugs 26 have degraded. This allows control over when fluidic pressure from inside the tubular 14 has access to the radially extendable member 12, as well as when fluid that causes the radially extendable member 12 to swell can have access to the radially extendable member 12.

In another embodiment the radially extendable member 12 can be configured to extend prior to cementing. In this embodiment the cement 30 can be pumped in a helical fashion through the annular space 16 defined between longitudinally adjacent portions of the radially extendable member 12 that may create a seal against the walls 20 due to being extended into contact with the walls 20. Regardless of whether the radially extendable member 12 extends before or after the cement 30 is pumped, the radially extendable member 12 establishes essentially a cement free pathway from the inside of the tubular 14 through the perforations 22 and through the radially extendable member 12 to the earth formation 38.

Figure 3:
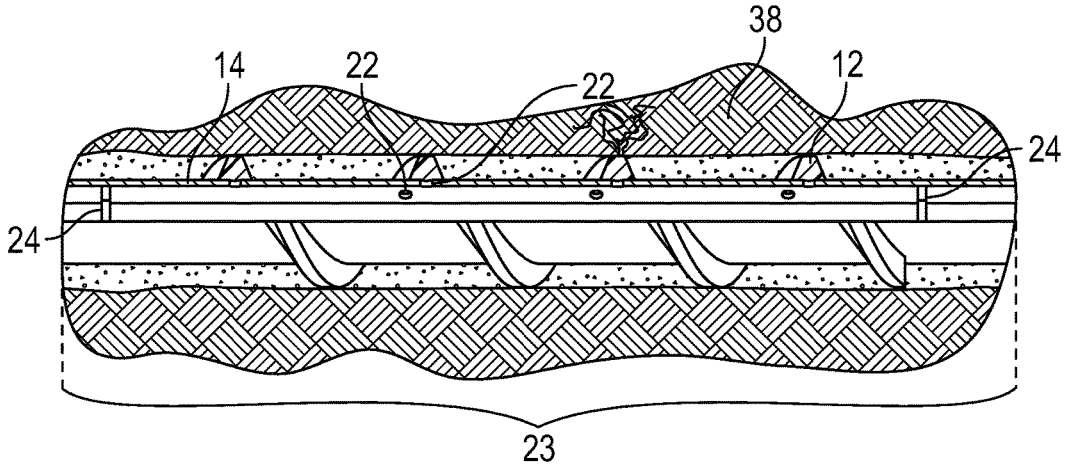
FIG. 3 depicts a partial quarter cross sectional view of the non-ballistic tubular perforating system of FIG. 1 with the radially extendable member swollen and valves isolating a fracing zone.
Figure 4:
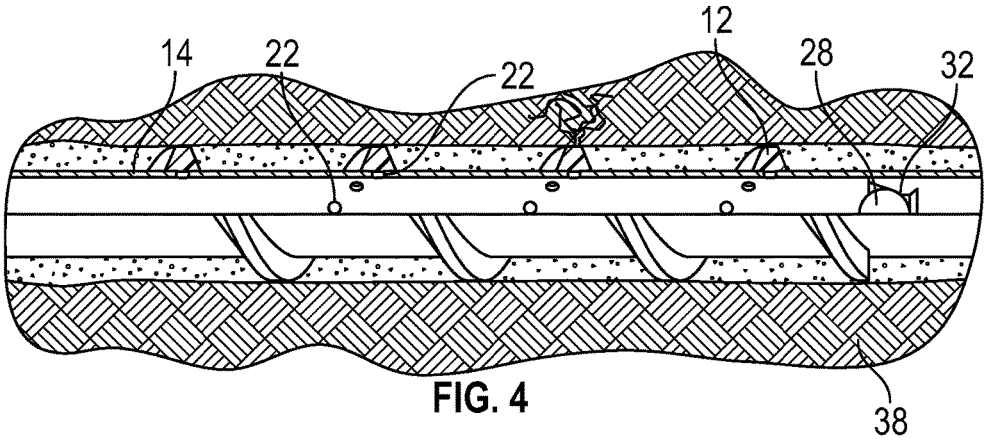
FIG. 4 depicts a partial quarter cross sectional view of the non-ballistic tubular perforating system of FIG. 1 with the radially extendable member swollen and a ball sealed on a seat.

The perforations 22 can be divided up into one or more zones 23, with just a single one of the zones 23 being illustrated herein. Methods can be employed, to prevent simultaneous pressuring up of all zones 23 located along the system 10. For example, valves 24 can be employed, as illustrated in FIG. 3, to isolate and frac (or treat in other ways) only the zone 23 located between the two valves 24. Alternately, a ball 28 can be sealed against a seat 32, as illustrated in FIG. 4, to pressure up against the radially extendable member 12 in the zones 23 positioned upstream of the seat 28 while leaving the radially extendable member 12 in zones downstream of the seat 32 intact and in sealing contact with the tubular 14. Leaving radially extendable member 12 intact in one or more of the zones 23 can prevent fluid from flowing through the perforations 22 in those zones 23 until a later time when the radially extendable member 12 covering the perforations 22 in those zones 23 has been breached.

Figure 5:
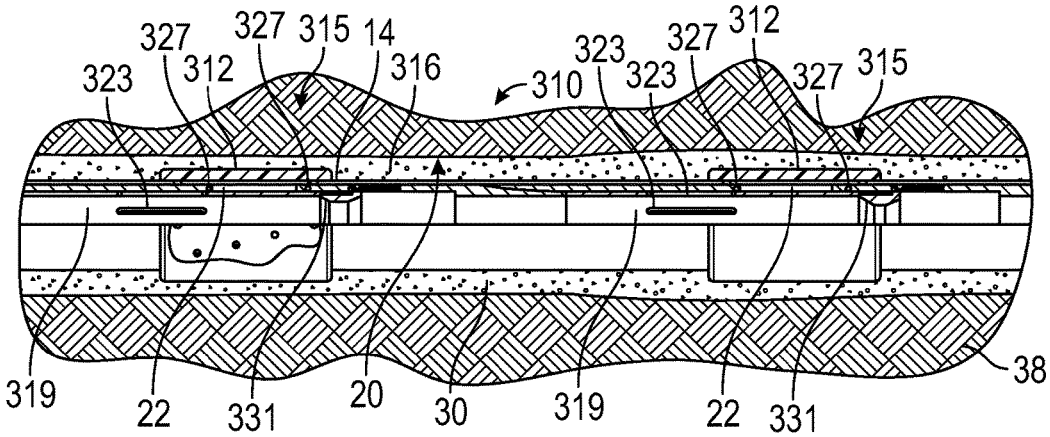
FIG. 5 depicts a partial quarter cross sectional view of an alternate embodiment of a non-ballistic tubular perforating system disclosed herein with a radially extendable member in an non-extended condition.
Figure 6:
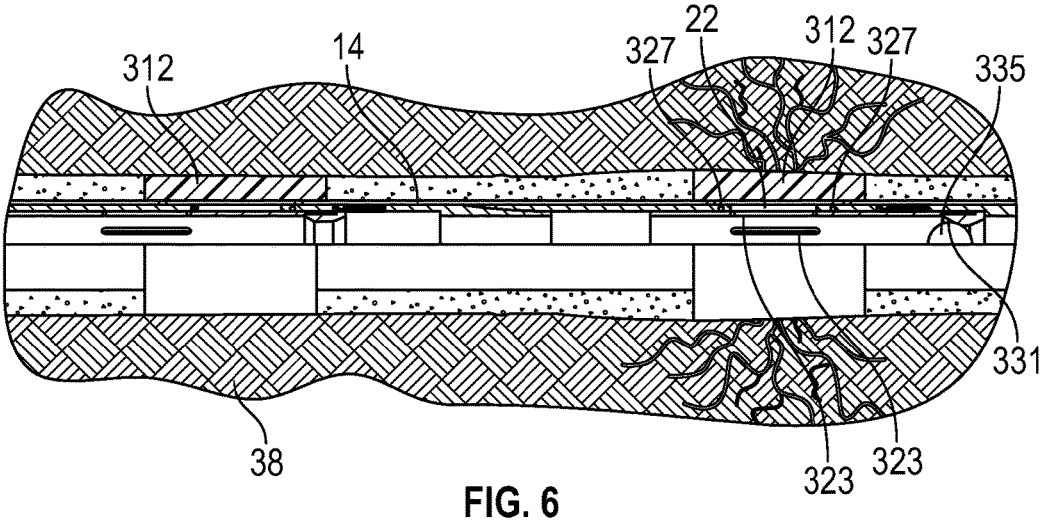
FIG. 6 depicts a partial quarter cross sectional view of the non-ballistic tubular perforating system of FIG. 5 in a radially extended condition.

Referring to FIGS. 5 and 6, an alternate embodiment of a non-ballistic tubular perforating system is illustrated at 310. The system 310 employs radially extendable member 312 at discrete positions along the system 310, such as at radially extendable packers 315, for example. As with the system 10, in the system 310 the radially extendable member 312 can be configured to radially extend after the cement 30 is pumped but before the cement 30 is hardened, or prior to pumping the cement 30. Radially extending the radially extendable member 312 after the cement 30 is pumped allows it to be pumped through the annular clearance between the walls 20 of the wellbore 38 and the radially extendable member 312. After-which radially extending of the radially extendable member 312 displaces some more of the cement 30 as the radially extendable member 312 radially extends into contact with the walls 20. Pumping the cement 30 after the radially extendable member 312 is in sealing contact with the walls 20 may require running an inner string within the tubular 14 to pump the cement 30 into the isolated annular spaces 316 between the adjacent portions of the radially extendable member 312.

The perforations 22 in the tubular 14 of system 310 are in the shape of elongated slots. In this embodiment a sleeve 319 with ports 323 therethrough is positioned relative to each of the packers 315 such that the ports 323 are initially longitudinally misaligned with the perforations 22. Seals 327 between the sleeves 319 and the tubular 14 occlude fluid communication between the ports 323 and the perforations 22 until the sleeves 319 have moved to longitudinally align the ports 323 with the perforations 22. This blockage of fluid or other environmental conditions can prevent pressure from rupturing the radially extendable member 312 until desired, and can prevent fluid or other environmental conditions that causes the radially extendable member 312 to radially extend from reaching the radially extendable member 312 until desired. This blockage can also isolate the plugs 26 from exposure to fluid that can cause the plugs 26 to dissolve until desired.

In the illustrated embodiment the sleeves 319 include a seat 331 that is receptive to a runnable plug 335, such as the ball shown. Seating the ball 335 allows pressure built against the plug 335 to move the sleeve 319 to thereby align the ports 323 with the perforations 22 to establish fluidic communication therethrough. Other embodiments are contemplated that employ other means, such as a shifting tool, for example, to move the sleeves 319. Once fluidic communication is established through the ports 323 and the perforations 22 pressurized fluid can flow therethrough and breach the radially extendable member 312 in a fashion similar to that of the system 10.

The plugs 26 can be made of a degradable material such as a high strength controlled electrolytic metallic material that is degradable in brine, acid, or an aqueous fluid. For example, a variety of suitable materials and their methods of manufacture are described in United States Patent Application Publication No. 2011/0135953 (Xu et al.), the Patent Application Publication of which is hereby incorporated by reference in its entirety. The invention is not limited to this material, however, and the plugs 26 can be made of other degradable or dissolvable materials such as, Polyglycolic Acid or calcium carbonate, for example. When the plugs 26 are made of calcium carbonate or a material containing sufficient amounts of calcium carbonate, the plugs 26 can dissolve when exposed to a solution that causes calcium carbonate to dissolve.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A non-ballistic tubular perforating system comprising:

a tubular having a wall with perforations therethrough; and at least one radially extendable member positioned radially of the perforations configured to displace cement radially of the tubular and configured to radially extend prior to the cement being pumped;

wherein the at least one radially extendable member is helically wrapped around the tubular.

2. The non-ballistic tubular perforating system of claim 1, wherein the at least one radially extendable member is extendable from a non-extended condition to an extended condition.

3. The non-ballistic tubular perforating system of claim 2, wherein the at least one radially extendable member increases dimensionally in both radial and longitudinal directions in the extended condition as compared to the non-extended condition.

4. The non-ballistic tubular perforating system of claim 1, wherein the non-ballistic tubular perforating system is runnable within a borehole in an earth formation, and cement is positionable within an annular space defined between the tubular and walls of the borehole.

5. The non-ballistic tubular perforating system of claim 4, wherein the radially extending of the at least one radially extendable member causes the at least one radially extendable member to contact walls of the borehole.

6. The non-ballistic tubular perforating system of claim 1, wherein the at least one radially extendable member is breachable by fluid pumped thereagainst through the perforations.

7. The non-ballistic tubular perforating system of claim 6, wherein fluid pumped through the breached at least one radially extendable member can treat an earth formation through one or more of fracturing, pumping proppant and acid treating.

8. The non-ballistic tubular perforating system of claim 1, wherein the perforations are plugged with a dissolvable material.

9. The non-ballistic tubular perforating system of claim 8, wherein the dissolvable material is a controlled electrolytic metallic material.

10. The non-ballistic tubular perforating system of claim 1, wherein a volume of the at least one radially extending member does not increase during radial extension thereof.

11. The non-ballistic tubular perforating system of claim 1, further comprising:

at least one occluding member configured to initially prevent fluid inside the tubular from reaching the at least one radially extendable member.

12. The non-ballistic tubular perforating system of claim 11 wherein the at least one occluding member is a degradable plug.

13. The non-ballistic tubular perforating system of claim 1, wherein the at least one radially extendable member includes one of a swellable material, an inflatable member, and a shape memory material.

14. The non-ballistic tubular perforating system of claim 1, wherein the at least one radially extendable member is configured to radially extend after cement is positioned within the annular space but before the cement hardens.

15. The non-ballistic tubular perforating system of claim 14, wherein the radially extending of the at least one radially extendable member causes additional displacement of cement in the annular space.

16. The non-ballistic tubular perforating system of claim 1, wherein the at least one radially extendable member includes one of a swellable material and a shape memory material.

17. A method of opening perforations in a tubular system comprising:

cementing an annular space between a tubular and a borehole in an earth formation;

radially increasing at least one radially extendable member positioned radially outwardly of perforations in the tubular, the at least one radially extendable member including one of a swellable material, an inflatable member, and a shape memory material, the at least one radially extendable member helically wrapped around the tubular;

pumping fluid through the tubular; and breaching the at least one radially extendable member and establishing fluidic communication between an inside of the tubular and the earth formation.

18. The method of opening perforations in a tubular system of claim 17, wherein the radially extending of the at least one radially extendable member occurs after the cementing but before the cement has hardened.

19. The method of opening perforations in a tubular system of claim 17, further comprising contacting walls of the borehole with the at least one radially extendable member after the at least one radially extendable member has radially extended.

20. The method of opening perforations in a tubular system of claim 17, further comprising plugging the perforations with plugs made of a degradable material.

21. The method of opening perforations in a tubular system of claim 20, further comprising dissolving the plugs and exposing the at least one radially extendable member to fluid pumped through the tubular via the perforations.

22. The method of opening perforations in a tubular system of claim 17, further comprising initially occluding fluid communication between an inside of the tubular and the at least one radially extendable member.

23. The method of opening perforations in a tubular system of claim 22, further comprising establishing fluid communication between an inside of the tubular and the at least one radially extendable member.

24. The method of claim 17, wherein radially increasing the at least one radially extendable member occurs before the cementing.

* * * * *